US005353971A

United States Patent [19]

Vaziri

[11] Patent Number: 5,353,971

[45] Date of Patent: Oct. 11, 1994

[54] ELECTRIC CAULKING GUN APPARATUS

[76] Inventor: Bijan Vaziri, 8902 Central Ave., Morton Grove, Ill. 60053

[21] Appl. No.: 58,148

[22] Filed: May 10, 1993

[51] Int. Cl.[5] ..... B05C 17/01

[52] U.S. Cl. ..... 222/326; 222/333; 222/463

[58] Field of Search ..... 222/326, 333, 390, 463

[56] References Cited

U.S. PATENT DOCUMENTS

| | | | |
|---|---|---|---|
| 1,709,445 | 4/1929 | Tomes | 222/326 |
| 3,208,638 | 9/1965 | Frenzel et al. | 222/333 X |
| 3,790,048 | 2/1974 | Luciano et al. | 222/390 |
| 3,799,407 | 3/1974 | Loethen et al. | 222/333 |
| 4,258,866 | 3/1981 | Bergman | 222/333 |
| 4,260,076 | 4/1981 | Bergman | 222/333 X |
| 4,335,834 | 6/1982 | Zepkin | 222/333 X |
| 4,583,934 | 4/1986 | Hata et al. | 222/333 X |
| 4,615,469 | 10/1986 | Kishi et al. | 222/333 X |
| 5,246,144 | 9/1993 | Cathcart, Sr. et al. | 222/326 X |

FOREIGN PATENT DOCUMENTS

| | | | |
|---|---|---|---|
| 1118729 | 2/1982 | Canada | 222/326 |
| 343003 | 11/1989 | European Pat. Off. | 222/326 |

*Primary Examiner*—Andres Kashnikow
*Assistant Examiner*—Lesley D. Morris
*Attorney, Agent, or Firm*—E. Michael Combs

[57] ABSTRACT

A caulking gun is arranged to include a cylindrical housing having an entrance opening, with a door pivotally mounted over the entrance opening to receive a caulking gun tube therewithin such that a reversing electric drive motor having a reciprocating piston relative to the housing is arranged to project into the caulking gun tube for expressing of material from the tube as the piston is directed within the tube structure.

6 Claims, 3 Drawing Sheets

ELECTRIC CAULKING GUN APPARATUS

BACKGROUND OF THE INVENTION

1. Field of the Invention

The field of invention relates to caulking gun apparatus, and more particularly pertains to a new and improved electric caulking gun apparatus wherein the same is directed to the dispensing of a viscous material relative to a container cartridge positioned within the tube structure.

2. Description of the Prior Art

Powered caulking gun structure is indicated in the prior art, wherein a rack and pinion drive is indicated in U.S. Pat. No. 4,669,636. U.S. Pat. No. 4,570,832 employs compressed air, wherein the U.S. Pat. No. 4,706,853 indicates a conventional mechanical ratchet caulking gun arrangement.

The instant invention attempts to overcome deficiencies of the prior art by providing for an electric powered caulking gun arranged for compact and efficient orientation expressing a product from a caulking gun and in this respect, the present invention substantially fulfills this need.

SUMMARY OF THE INVENTION

In view of the foregoing disadvantages inherent in the known types of caulking gun apparatus now present in the prior art, the present invention provides an electric caulking gun apparatus wherein a reversible electric drive motor is arranged to project a piston in cooperation with a cartridge to permit expressing of viscous material therefrom. As such, the general purpose of the present invention, which will be described subsequently in greater detail, is to provide a new and improved electric caulking gun apparatus which has all the advantages of the prior art caulking gun apparatus and none of the disadvantages.

To attain this, the present invention provides a caulking gun arranged to include a cylindrical housing having an entrance opening, with a door pivotally mounted over the entrance opening to receive a caulking gun tube therewithin such that a reversing electric drive motor having a reciprocating piston relative to the housing is arranged to project into the caulking gun tube for expressing of material from the tube as the piston is directed within the tube structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electric caulking gun apparatus which has all the advantages of the prior art caulking gun apparatus and none of the disadvantages.

It is another object of the present invention to provide a new and improved electric caulking gun apparatus which may be easily and efficiently manufactured and marketed.

It is a further object of the present invention to provide a new and improved electric caulking gun apparatus which is of a durable and reliable construction.

An even further object of the present invention is to provide a new and improved electric caulking gun apparatus which is susceptible of a low cost of manufacture with regard to both materials and labor, and which accordingly is then susceptible of low prices of sale to the consuming public, thereby making such electric caulking gun apparatus economically available to the buying public.

Still yet another object of the present invention is to provide a new and improved electric caulking gun apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
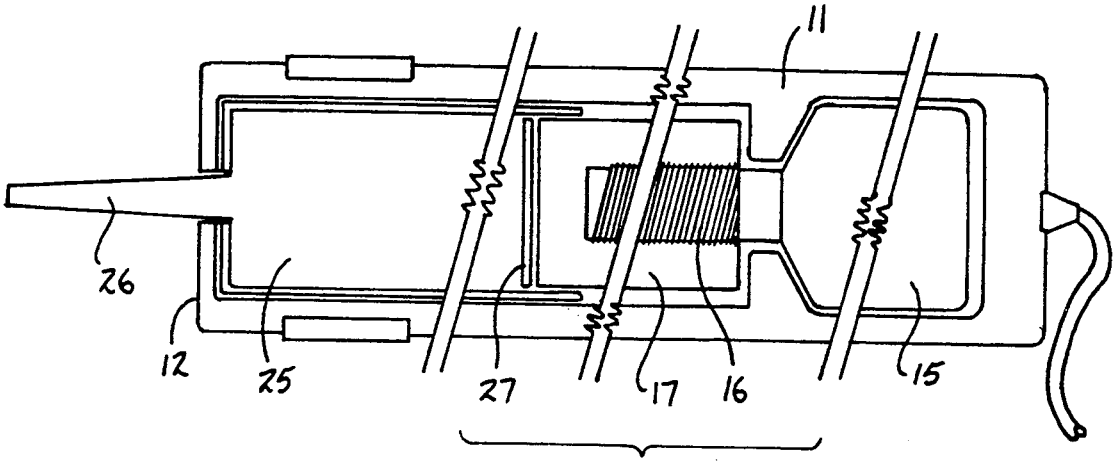
FIG. 1 is a diagrammatic depiction of the drive motor and cartridge orientation within the tubular housing of the invention.
Figure 2:
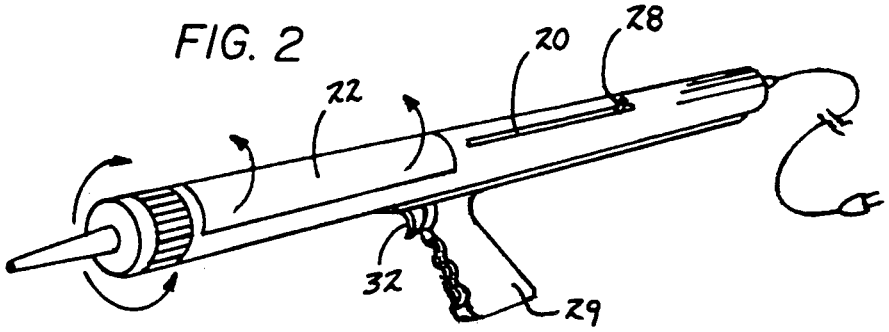
FIG. 2 is an isometric illustration of the invention.

With reference now to the drawings, and in particular to FIGS. 1 to 6 thereof, a new and improved electric caulking gun apparatus embodying the principles and concepts of the present invention and generally designated by the reference numeral 10 will be described.

Figure 3:
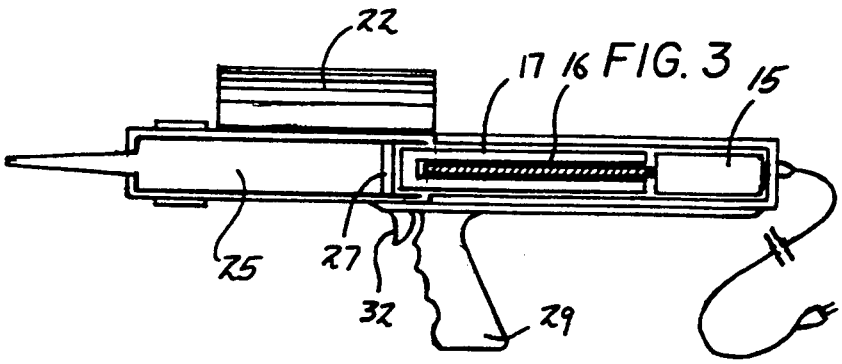
FIG. 3 is an orthographic view of the invention indicating the orientation of the caulking cartridge within the housing of the invention.
Figure 3A:
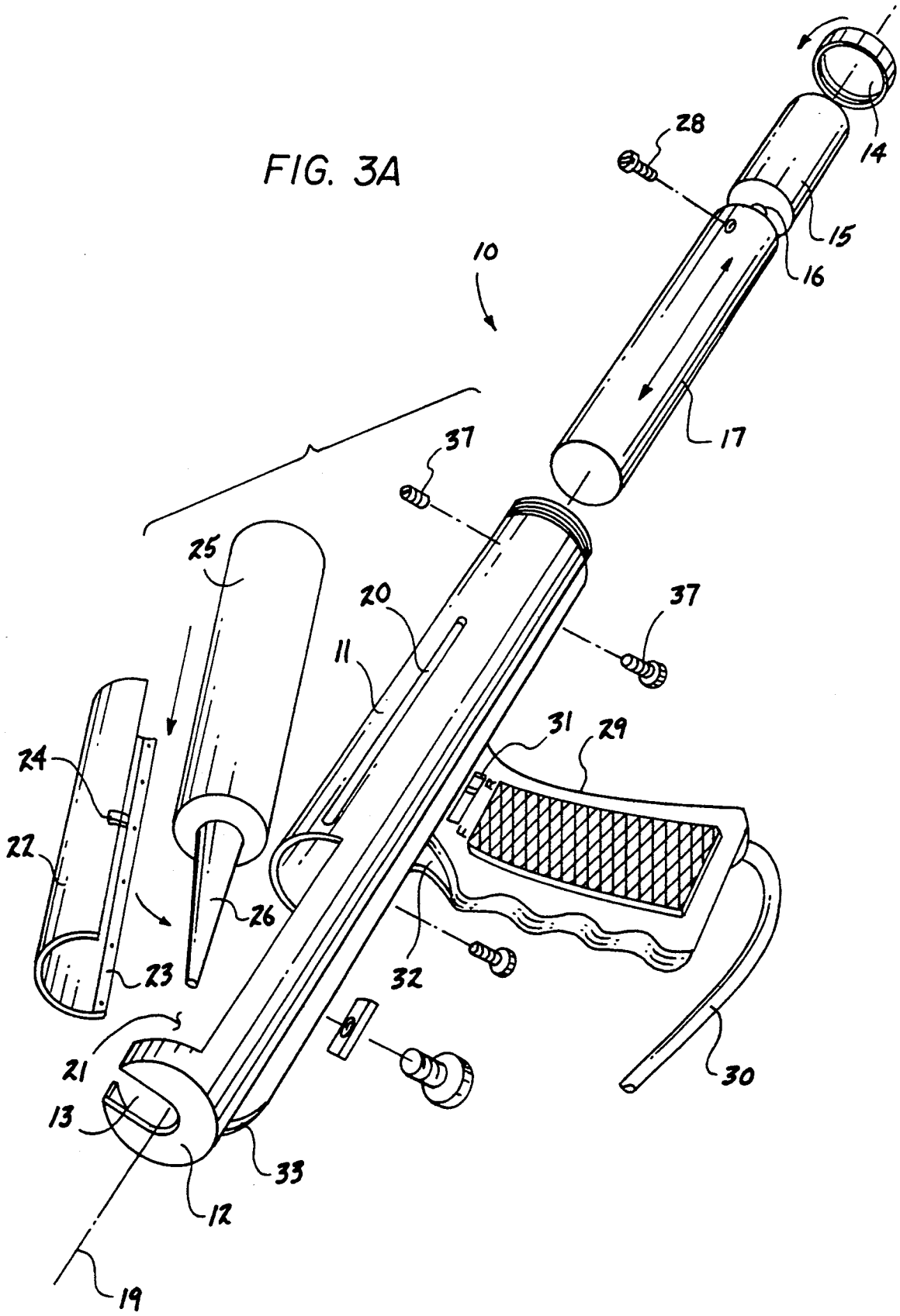
FIG. 3*a* is an isometric illustration, in somewhat exploded view, illustrating the various drive components thereof.
Figure 4:
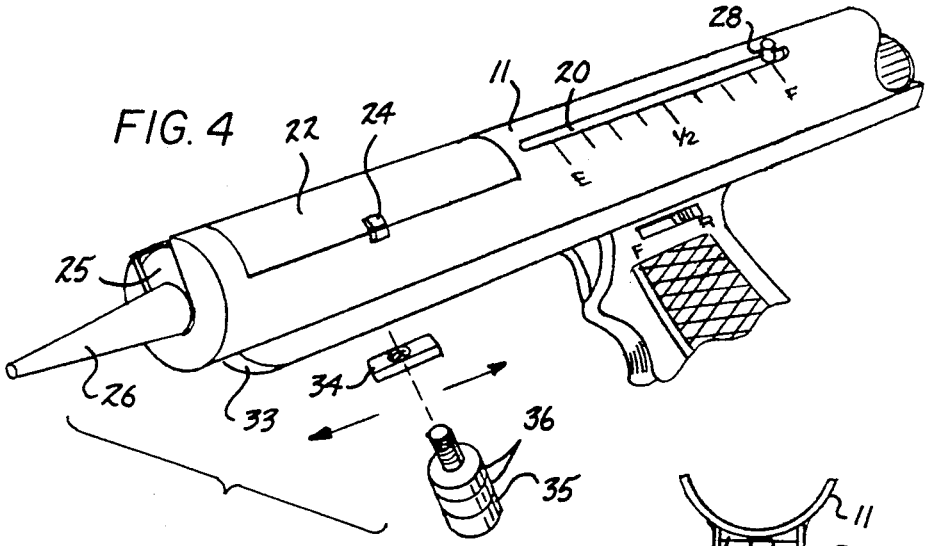
FIG. 4 is an isometric illustration of the invention employing a counterweight structure.
Figure 5:
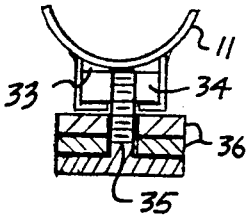
FIG. 5 is an orthographic cross-sectional illustration of the counterweight structure.
Figure 6:
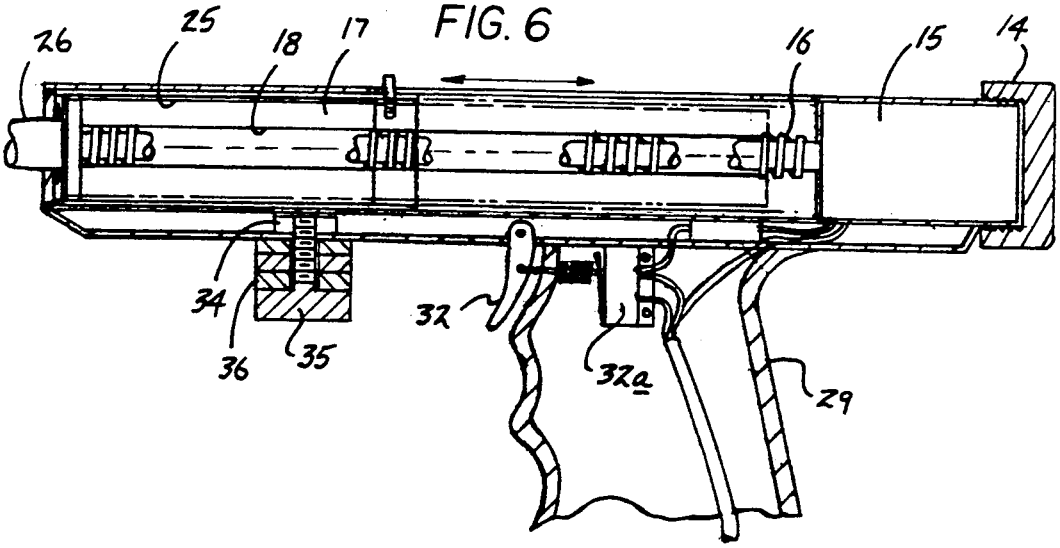
FIG. 6 is an orthographic side view of the counterweight structure arranged within the guide slot of the housing.

More specifically, the electric caulking gun apparatus 10 of the instant invention essentially comprises a tubular housing 11 having a housing front wall 12, including a receiving slot 13 directed therein, with a housing end wall cap 14 threadedly secured to a rear distal end of the tubular housing 11 spaced from the front wall 12, with an electric reversible drive motor 15 directed into the tubular housing 11 in adjacency to the cap 14, in a manner as indicated in the FIG. 3*a*. A drive screw 16 is coaxially oriented relative to the drive motor 15, with the drive motor 15 configured as a reversible electric drive motor type, with a piston 17 having a central threaded piston bore 18 threadedly receiving the drive screw 16 therewithin. The drive motor 5, the drive screw 16, the piston 17, and the piston bore 18 are coaxially aligned along the housing axis 19, in a manner as indicated in FIG. 3*a*. A guide slot 20 directed through the tubular housing 11 between a housing semi-cylindrical wall opening 21 with the wall opening including a door 22, the door having a door hinge 23 pivotally mounting the door to the opening, with the door including a door latch 24 for selective securement of the door to the housing. The housing rear end portion includes a piston guide lug 28 slidably oriented along the guide slot 20, with the guide lug 28 radially directed into and fixedly secured to the piston 17, in a manner as indicated in FIG. 3*a* and FIG. 4. A caulking tube 25 having a caulking tube nozzle 26 that is received through the receiving slot 13 includes a caulking tube end plate 27 for abutment with the piston 17, such that projection of the piston towards the nozzle 26 expresses viscous fluid within the caulking tube 25, with the FIG. 6 indicating the piston projected towards the nozzle 26 and the preceding expenditure of the viscous fluid from the cartridge 26. The type and construction of caulking tubes 25 are known in the art and details thereto are believed to be understood by one of ordinary skill in the art in cooperation with the instant invention. Further, it should be understood that the guide slot 20 is oriented parallel to the axis 19 to provide for linear alignment and guidance in a non-rotative manner of the piston 17 as it projects towards the end plate 27 upon rotation of the drive screw 16 within the internally threaded piston bore 18.

A handle 29 fixedly mounted to the tubular housing 11 at an oblique angle includes an electric power supply 30, as well as a trigger switch 32 operative through an on/off switch 32*a* (see FIG. 6), with a reversing switch 31 (see FIG. 3) conveniently mounted to the handle for ease of reversing of the drive motor in use.

The FIGS. 3*a*, 4, 5, and 6 indicates the use of a guide track having a slot 33 fixedly mounted to the housing parallel to the axis and extending from the front wall 12 to the handle 29 such that a slide plate 34 is slidably mounted within the guide track 33, with a slide fastener rod 35 threadedly received within the slide plate 34 extending from an orientation exteriorly of the guide slot such that counterweight plate members 36 are arranged for securement between the slide fastener rod 35 and the guide slot to provide for counterweighting of the organization upon expenditure of viscous fluid relative to the cartridge 25. It should be understood that as material is expended from the cartridge, the counterweight structure is slid towards the front wall 12 to compensate for loss of weight and thereby provide for ease of handling of the organization in use. Further it should be understood as exemplified in FIG. 3A, the drive motor has fasteners such as fixing screws 37 extending through the housing 11 and fixedly received for abutment with the drive motor 15 to prevent rotation of the drive motor relative to the housing 11 in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electric caulking gun apparatus, comprising, a tubular housing, the tubular housing including a housing front wall and a rear end wall portion, with a housing end wall cap arranged for securement to the end wall portion, and the front wall having a receiving slot directed into the front wall, and an electric reversible drive motor mounted within the tubular housing in adjacency to the end wall cap, with the drive motor having a drive screw rotatably and operably mounted to the drive motor, with a piston, the piston having a piston internally threaded central bore, with the central bore threadedly receiving the drive screw, and the tubular housing symmetrically oriented about a housing axis, with the drive motor, the drive screw, the piston, and the piston bore coaxially aligned along the housing axis, and a housing wall opening, with the wall opening including a door, the door having a door hinge pivotally mounting the door to the opening, with the door including a door latch for selective securement of the door to the housing, and a caulk tube arranged for reception within the opening, with the caulk tube having an end plate arranged for abutment with the piston.

2. An apparatus as set forth in claim 1 wherein the housing further includes a guide slot oriented parallel to the axis and positioned between the opening and the rear end portion of the tubular housing, with the piston including a guide lug fixedly mounted to the piston, with the guide lug projecting through the guide slot to maintain the piston in a non-rotative orientation relative to the housing upon rotation of the drive screw.

3. An apparatus as set forth in claim 2 including at least one drive motor fastener directed through the housing in engagement with the drive motor fixedly orienting the drive motor within the tubular housing in a non-rotative relationship.

4. An apparatus as set forth in claim 3 including a handle, the handle including a switch member for effecting selective actuation of the drive motor.

5. An apparatus as set forth in claim 4 with the tubular housing including a guide track fixedly mounted to an exterior surface of the tubular housing parallel to the axis and extending from the front wall to the handle, with the guide track including a slide plate, the slide plate including a slide fastener threadedly received within the slide plate, with the slide fastener projecting exteriorly of the guide track, and at least one counterweight member arranged for mounting between the guide track and the fastener to effect counterweighting of the tubular housing upon expressing of a viscous material from the caulk tube.

6. An electric caulking gun apparatus, comprising, a tubular housing, the tubular housing including a housing front wall and a rear end wall portion, with a housing end wall cap arranged for securement to the end wall portion, and the front wall having a receiving slot directed into the front wall, and an electric reversible drive motor mounted within the tubular housing in adjacency to the end wall cap, with the drive motor having a drive screw rotatably and operably mounted to the drive motor, with a piston, the piston having a piston internally threaded central bore, with the central bore threadedly receiving the drive screw, and the tubular housing symmetrically oriented about a housing axis, with the drive motor, the drive screw, the piston, and the piston bore coaxially aligned along the housing axis, and a housing wall opening, with the wall opening including a door, the door having a door hinge pivotally mounting the door to the opening, with the door including a door latch for selective securement of the door to the housing, and a caulk tube arranged for reception within the opening, with the caulk tube having an end plate arranged for abutment with the piston, and the tubular housing including a guide track fixedly mounted to an exterior surface of the tubular housing parallel to the axis and extending from the front wall to the handle, with the guide track including a slide plate, the slide plate including a slide fastener threadedly received within the slide plate, with the slide fastener projecting exteriorly of the guide track, and at least one counterweight member arranged for mounting between the guide track and the fastener to effect counterweighting of the tubular housing upon expressing of a viscous material from the caulk tube.

* * * * *